United States Patent [19]

Davlantes

[11] Patent Number: 4,651,793

[45] **Date of Patent: * Mar. 24, 1987**

[54] PET DOOR FLAP WITH SLOW MOVING SILL

[76] Inventor: George N. Davlantes, 7844 Gazette Ave., Canoga Park, Calif. 91306

[ * ] Notice: The portion of the term of this patent subsequent to Oct. 11, 2000 has been disclaimed.

[21] Appl. No.: 741,640

[22] Filed: Jun. 5, 1985

Related U.S. Application Data

[63] Continuation-in-part of Ser. No. 424,454, Sep. 27, 1982, abandoned.

[51] Int. Cl.[4] ..... E06B 7/28

[52] U.S. Cl. ..... 160/92; 49/169; 49/488; 160/116; 160/DIG. 16

[58] Field of Search ..... 160/92, DIG. 16, 368 R, 160/368 S, 254, 116, 180, 327; 49/168, 169, 488, 171

[56] References Cited

U.S. PATENT DOCUMENTS

| | | | |
|---|---|---|---|
| 839,566 | 12/1906 | Eliezer | 160/375 |
| 1,666,328 | 4/1928 | Dennis | 49/496 |
| 1,681,134 | 8/1928 | Ruth | 49/488 |
| 1,690,649 | 11/1928 | Radford | 160/40 |
| 1,728,453 | 9/1929 | Stanton | 49/488 |
| 2,560,661 | 7/1951 | Poovey | 160/179 |
| 2,748,854 | 6/1956 | Lynch | 160/179 |
| 2,758,646 | 8/1956 | Johnson | 160/354 |
| 2,832,406 | 4/1958 | Turenne | 160/179 |
| 2,839,791 | 6/1958 | Lee | 160/DIG. 8 |
| 2,882,964 | 4/1959 | Watkin | 160/330 |
| 3,241,198 | 3/1966 | Bermann | 49/478 |
| 3,464,158 | 9/1969 | Greene | 49/168 |
| 3,654,733 | 4/1972 | Blackwell | 49/168 |
| 3,690,299 | 9/1972 | Johnson | 119/1 |
| 3,797,554 | 3/1974 | Johnson | 160/354 |
| 3,811,224 | 5/1974 | Garrison | 49/168 |
| 3,918,203 | 11/1975 | Ellison, Jr. | 49/168 |
| 4,047,331 | 9/1977 | Davlantes | 49/171 |
| 4,053,007 | 10/1977 | Griffith | 160/180 |
| 4,173,099 | 11/1979 | Robb | 49/168 |
| 4,408,416 | 10/1983 | Davlantes | 49/168 |
| 4,480,407 | 11/1984 | Needham et al. | 49/168 |

FOREIGN PATENT DOCUMENTS

| | | | |
|---|---|---|---|
| 0062153 | 10/1982 | European Pat. Off. | 49/488 |
| 2102868 | 2/1983 | United Kingdom | 49/488 |

*Primary Examiner*—Ramon S. Britts
*Assistant Examiner*—David L. Talbott
*Attorney, Agent, or Firm*—Lahive & Cockfield

[57] ABSTRACT

A flexible, resilient pet door flap hung in a frame so that it is movable in the horizontal direction between vertical side walls has peripheral Z-shaped edge portions terminating in web portions for effecting a seal against the side walls. The bottom portion of the frame includes a movable sill with magnets corresponding to magnets in the flap, and a secured piston in the frame having a surface adjacent a surface of the sill, with viscous material therebetween, to inhibit movement of the sill.

10 Claims, 5 Drawing Figures

PET DOOR FLAP WITH SLOW MOVING SILL

This application is a continuation-in-part of application Ser. No. 424,454, filed Sept. 27, 1982, now abandoned.

BACKGROUND

This invention relates generally to pet door flaps, and particularly to pet door flaps having edges for providing a seal when the flap is in the closed position, and a slow moving sill for improving the seal at the bottom edge.

Conventionally, access doors for pets have been equipped with swinging flaps, usually top-hinged so as to be pushed open easily by a pet, such as a dog or cat, passing through. The flaps usually swing in either direction. A problem for owners of such access doors, and hence for the producers of the doors, is ensuring that a good seal exists between the edges of the flap and the frame in which the flap hangs when it is at rest. In U.S. Pat. No. 4,047,331 I disclosed a flap having wipers along the flap's vertical edges. The wipers helped seal the flap against the frame.

Further improvements in sealing pet access door flaps against their frames is still desirable, however. Accordingly, it is an object of this invention to provide a pet door flap with improved edge sealing qualities that is inexpensive to manufacture and durable in use.

SUMMARY OF THE INVENTION

The invention comprises a pet door with frame means having top, bottom and vertical side frame members defining an opening having a width, and generally planar flap means for closing the opening. The flap means is hingedly connected to the top frame member and extends downwardly to the bottom frame member. The flap means has vertical edge portions of resilient material, each edge portion comprising in cross-section a convoluted shape, the flap means having a width selected to be greater than the width of the frame opening.

Preferably, the convoluted shape is generally that of a Z, and the edge portion terminates in a web portion that is co-planar with the flap means.

In a preferred embodiment of the invention, the flap means comprises an integral flap of resilient, flexible material, and the flap means is mounted in said top frame member for slidable movement in the horizontal direction between the vertical frame members.

In another preferred embodiment of the invention, a pet door having frame means comprising top, bottom and vertical side frame members defining an opening, and a generally planar flap means of resilient, flexible material for closing the opening, the flap means being hingedly connected to the top frame member and extending downwardly to the bottom frame member, with a bottom portion bearing first magnetic means, includes a bottom frame member that has a sill means mounted for vertical movement in the bottom frame member to meet the flap bottom portion, the sill means bearing second magnetic means corresponding in position to the flap means first magnetic means, and the bottom frame member including means for inhibiting the vertical movement of the sill means.

Preferably, the inhibiting means comprises piston means secured in the bottom frame member and having a first inhibiting surface adjacent a second inhibiting surface defined by a surface of the sill means, defining a gap therebetween that is filled with highly viscous material so that if the will were raised by hand, it would take at least a minute to drop back to its original position; the gap is arranged to stay substantially constant in area throughout the movement of the sill means.

BRIEF DESCRIPTION OF THE DRAWING

Other objects, features and advantages of the invention will be described in, or be readily apparent from, the following description of a preferred embodiment, including the drawing thereof, in which.

DESCRIPTION OF A PREFERRED EMBODIMENT

Figure 1:
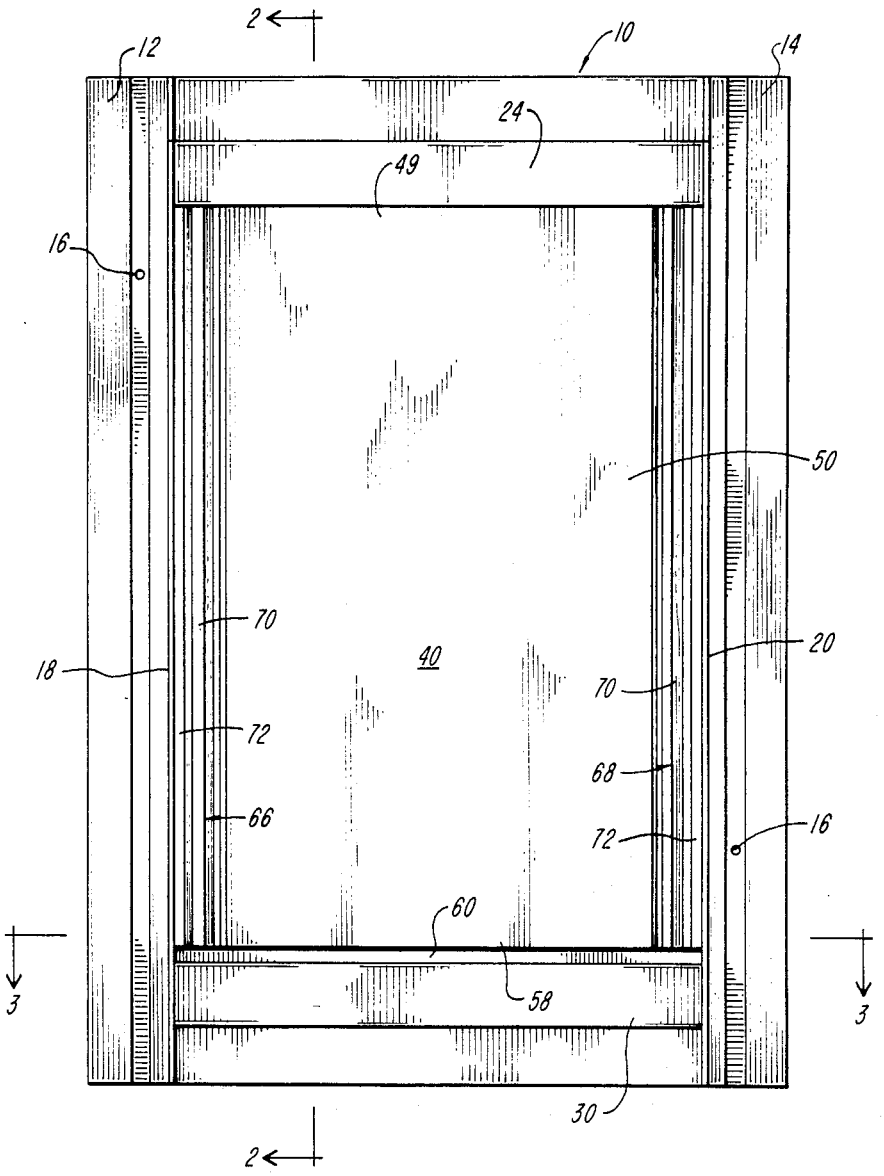
FIG. 1 is a front elevation view of a flap within a frame suitable for insertion into a door or wall.
Figure 2:
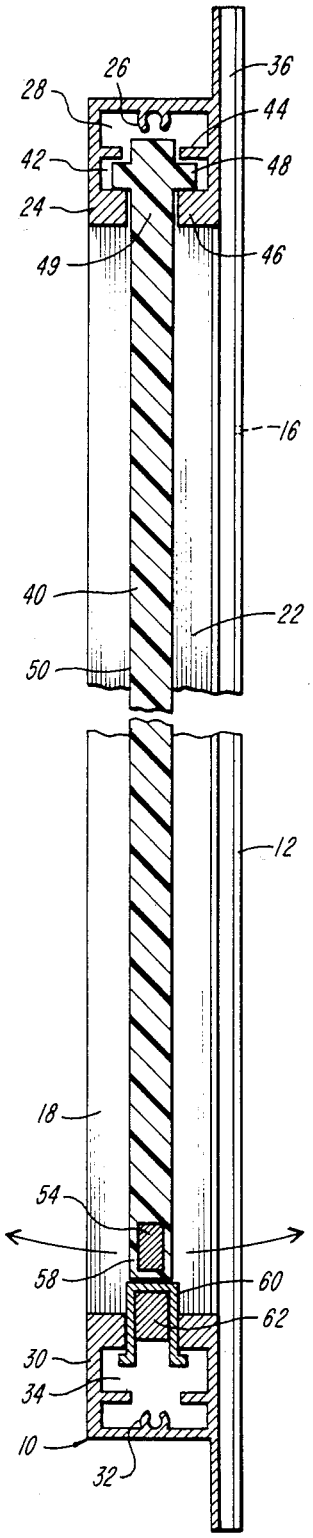
FIG. 2 is a sectional view of the flap and frame along the line 2—2 of FIG. 1.
Figure 3:
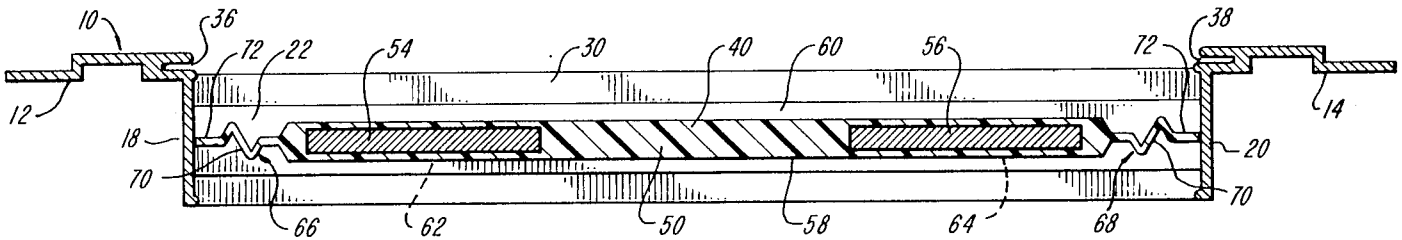
FIG. 3 is a cross-sectional view of the flap and frame along the line 3—3 of FIG. 1.

As shown in FIGS. 1, 2 and 3, the pet door includes an aluminum frame 10 suitable for insertion into an aperture created in a door or wall of a residence or, in fact, in any wall-like obstruction. The object is to allow a pet to pass through an opening in the wall. The exact configuration and dimensions of such a frame will vary with the nature of the wall in which it is inserted and the size of the pet expected to use the pet door. The configuration of the frame 10 shown in the drawing is typical.

The frame 10 includes two vertical outer flanges 12,14 for mounting the frame 10. The flanges 12,14 are intended to be connected to the interior surface of the wall in which the frame 10 is mounted, by screws passing through screw holes 16 in the flanges 12,14. Extending perpendicularly to the flanges 12,14 are vertical side frame members or walls 18,20. These vertical side walls 18,20 extend through the depth of the wall in which the frame 10 is inserted. The horizontal distance between the parallel side walls 18,20 define the width of the opening 22 formed by the frame.

Extending across the top of the frame 10 is a tubular top frame member 24, secured to the vertical side walls 18,20 by screws passing through the side walls 18,20 into threaded bases 26 formed in the interior 28 of the top frame member 24. Extending across the bottom of the frame 10 is a bottom frame member 30, similar in construction to the top frame member 24. The bottom frame member 30 is similarly secured to the vertical side walls 18,20 by screws passing through the side walls 18,20 into threaded bases 32 formed in the interior 34 of the bottom frame member 30.

The vertical flanges 12 and 14 include vertical channels 36 and 38 for the insertion of a lock plate, not shown. The lock plate may be locked in place from the inside of the wall in which the frame is inserted to cover the frame opening 22 securely from inside when the pet door is not in use.

A pet access flap 40 is mounted in the top frame member 24 and extends downwardly to the bottom frame member 30. The flap 40 is a single molded piece of a flexible, resilient, weather-resistant material, such as rubber or plastic. The top frame member 24 has horizontal channels 42 defined by spaced apart parallel upper and lower strips 44,46 extending inwardly in the interior 28 of the member. The flap 40 includes horizontal protruding ridges 48 molded in the top portion 49 of the flap. The flap 40 is mounted in the top frame member 24 by the ridges 48 residing in the horizontal channels 42. The effect is that the flap 40 is hingedly mounted in the top frame member 24. The flap ridges 48 are slidable in the channels 42 in the horizontal direction so that the flap 40 as a whole is slidable and movable horizontally between the vertical side walls 18,20 of the frame 10.

The flap 40 has a large, generally planar, central portion 50. The central portion 50 is relatively thick so that it is durable and weather-resistant. The central portion 50 is pushed, from either side, by a pet wishing to go through the frame opening 22. The flap 40 is thus swingable about the top portion 49 in the direction shown by the arrows in FIG. 2.

A pair of spaced apart magnets 54,56 are embedded in the bottom portion 58 of the flap 40. A horizontal aluminum channel member or sill 60 is vertically movable in the bottom frame member 30, and a pair of spaced apart magnets 62,64 are secured in the channel member 60 at horizontal positions corresponding to the flap magnets 54,56. The bottom frame magnets 62,64 cooperate with the flap magnets 54,56 to arrest the flap 40 into a vertical position, closing the frame opening 22, quickly, after the flap 40 has been pushed open by a pet passing through.

The flap 40 has vertical edge portions 66,68, best illustrated in FIG. 3. The edge portions 66,68 are relatively thinner than the flap central portion 50. In cross-section, each edge portion 66,68 has a shape that may be described as convoluted. In the illustrative embodiment, each edge portion 66,68 has a generally Z-shaped portion 70. The shaped edge portion 66,68 terminates in a peripheral web portion 72 that is generally co-planar with the flap central portion 50.

The over-all horizontal dimension of the flap 40, free of the frame 10, is selected to be slightly larger than the width of the frame opening 22. As a result, when the flap 40 is hung vertically in the frame 10, the edge portions 66,68 are squeezed inwardly. The convoluted shaped portion 70 allows the flap 40 to absorb the restriction in dimension. The central portion 50 of the flap 40 and the peripheral web portions 72 remain generally co-planar. The resilience of the flap material meanwhile urges the peripheral web portions 72 against the vertical side walls 18,20 of the frame 10 to maintain a good sealing relationship.

The flap 40, moreover, is free to move horizontally between the vertical side walls 18,20, as a result of the arrangement by which the flap 40 is hung from the top frame member 24. This provides a self-adjusting characteristic for the flap 40.

In operation, then, the flap 40 is slidably and hingedly secured in the top frame member 24. The frame 10 is inserted into the aperture of a wall in a conventional manner. A pet passes through the opening 22 in the frame 10 by pushing the flap 40 with its body. After the pet passes through the opening 22, the flap 40 falls back to a vertical position, aided by the mutual attraction of the flap magnets 54,56 and the frame magnets 62,64. The magnets not only bring the flap 40 quickly to a vertical halt, but also ensure the alignment of the bottom 58 of the flap 40 with the sill 60 of the frame bottom member 30, and prevent movement of the flap 40 due to wind, etc.

The flap 40 is conveniently molded from a single piece of flexible, resilient material, having a durable thicker central portion and thinner, more resilient edge portions. The convoluted edge portions preferably take the Z shape of the illustrative embodiment, but may be of other zig-zag, or accordion-like shapes suitable for providing the intended resilience for creating a tight and effective seal between the flap 40 and the frame side walls 18,20.

Figure 5:
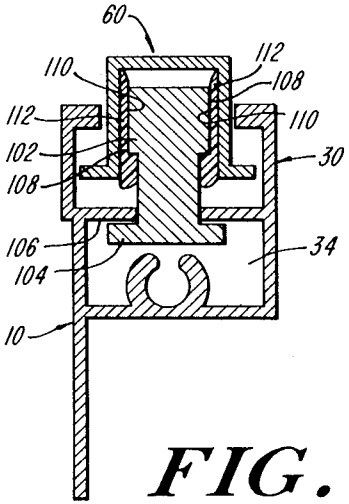
FIG. 5 is a sectional view of the bottom frame member of the embodiment of FIG. 4.
Figure 4:
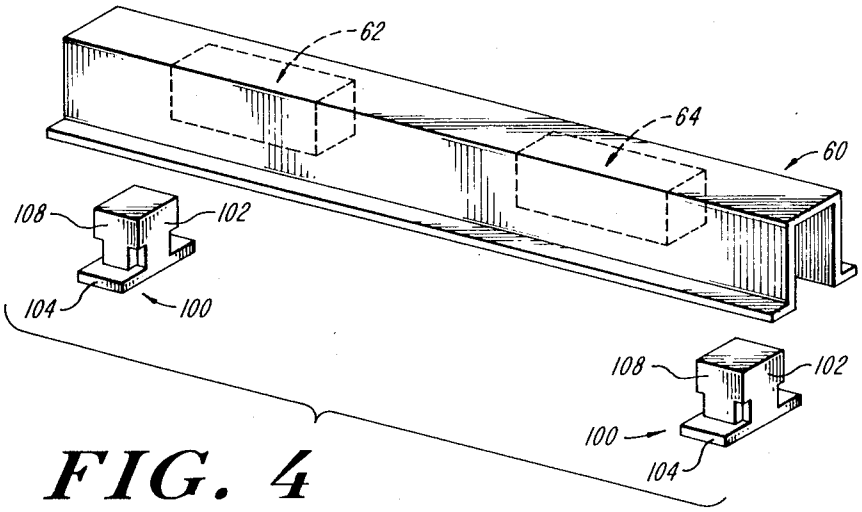
FIG. 4 is a perspective view of an embodiment exhibiting inhibited movement of the sill.

The embodiment illustrated in FIGS. 4 and 5 shows a feature that improves the function of the movable sill 60 in the bottom frame member 30. If the vertically movable sill 60 moves readily, it is possible that gusts of wind or sudden changes in air pressure on one side of the flap 40 will cause the flap 40 to bend, pulling up the sill 60 and allowing the flap 40 to belly out, breaking the vertical seal achieved by the flap web portions 72.

As FIGS. 4 and 5 show, the bottom frame member 30 now includes a pair of piston blocks 100 in the interior 34 of the bottom frame member 30. The piston blocks 100 have an upper portion 102 of generally rectangular cross section, and a lower foot portion 104 which is captured beneath inwardly extending ridges 106 of the bottom frame member 30. The piston blocks 100 extend upwardly into the hollow interior of the sill 60, so that the flat vertical surfaces 108 are adjacent the interior surfaces 110 of the movable sill 60.

The opposing surfaces 108,110 form a gap 112 between them that is filled with a highly viscous material 114. A variety of materials may be used for this purpose, the important characteristics of the material being that it not lose its viscosity or its dampening or inhibiting effect on the relative movement of the adjacent surfaces 108,110. One material that has proved successful for this purpose is automobile gasket sealant such as that made by Marsten Lubricants Ltd., of the United Kingdom, and distributed in the United States by McCord, of Detroit, Mich.

It is generally desirable to inhibit the vertical movement of the sill 60 (in the direction of the arrows of FIG. 5) enough to prevent transient wind gusts or changes in air pressure on the flap 40 from being able to pull up the sill 60, but to still allow it to change vertical position to adjust to meet the flap bottom portion as temperature change causes the system elements to expand or contract and change relative position. For example, it would be desirable for the sill 60, if it were raised to its highest position by hand, to take at least a minute to fall back to its lowest vertical position when it was let go.

The piston blocks 100 are furthermore best arranged so that the area of the gap 112, that is, the area of contact between the adjacent surfaces 108,110 remains substantially constant through the range of travel of the sill 60.

The frame on which the flap is hung may take many different forms and the "wall" through which the flap allows a pet to pass may take many different forms also. In my U.S. Pat. No. 4,047,331, for example, I showed a flap hung in a large panel for insertion into a sliding door unit. Other modifications of the illustrative embodiment may be devised by those skilled in the art without departing from the spirit of the invention as set forth in the following claims.

What is claimed is:

1. A pet door comprising frame means, said frame means comprising top, bottom and vertical side frame members defining an opening having a width, and generally planar flap means of resilient, flexible material for closing said opening, said flap means hingedly connected to said top frame member and extending downwardly to said bottom frame member, said flap means terminating in integral vertical edge portions of the same resilient, flexible material, each said edge portion comprising in cross-section a convoluted shape, said flap means having a width selected to be greater than said width of said opening.

2. The pet door of claim 1 wherein said edge portion comprises in cross-section a convoluted shape terminating in a web portion that is co-planar with said flap means.

3. The pet door of claim 1 wherein said edge portion comprises in cross-section a general Z-shape terminating in a web portion that is co-planar with said flap means.

4. The pet door of claim 1, 2 or 3 wherein said flap means is mounted in said top frame member for slidable movement in the horizontal direction between said vertical frame members.

5. The pet door of claim 1 wherein said flap means has a bottom portion bearing first magnetic means, said bottom frame member including a sill means mounted for vertical movement in said bottom frame member to meet said flap means bottom portion, said sill means bearing second magnetic means corresponding in position to said flap means first magnetic means, said bottom frame member including means for inhibiting said vertical movement of said sill means.

6. A pet door comprising frame means, said frame means comprising top, bottom and vertical side frame members, defining an opening having a width, and flap means for closing said opening, said flap means being made of a resilient, flexible material, being hingedly connected to said top frame member and extending downwardly to said bottom frame member, and comprising a general planar central thicker portion, and vertical edge portions comprising in cross-section a generally thinner convoluted shape terminating in a web portion that is co-planar with said flap means central portion, said flap means having a width selected to be greater than said width of said opening.

7. A pet door comprising:

frame means, said frame means comprising top, bottom and vertical side frame members defining an opening, and generally planar flap means of resilient, flexible material for closing said opening, said flap means hingedly connected to said top frame member and extending downwardly to said bottom frame member, said flap means having a bottom portion bearing first magnetic means, said bottom frame member including a sill means mounted for vertical movement in said bottom frame member to meet said flap means bottom portion, said sill means bearing second magnetic means corresponding in position to said flap means first magnetic means, said bottom frame member including means for inhibiting said vertical movement of said sill means.

8. The pet door of claim 7 wherein said means for inhibiting comprises:

piston means secured in said bottom frame member and having a first inhibiting surface, said sill means having a second inhibiting surface adjacent said piston first inhibiting surface, and defining a gap therebetween, and highly viscous material located in said gap.

9. The pet door of claim 8 wherein said gap defines an area that remains substantially constant throughout the movement of said sill means.

10. The pet door of claim 8 wherein said highly viscous material is selected so that when the sill is raised by hand it will take more than a minute to drop vertically to its original position.

* * * * *